United States Patent [19]

Nojima et al.

[11] Patent Number: 4,620,992

[45] Date of Patent: Nov. 4, 1986

[54] METHOD OF PRODUCING CAST COATED PAPER

[75] Inventors: Kazuhiro Nojima; Mikio Takahashi, both of Amagasaki, Japan

[73] Assignee: Kanzaki Paper Mfg. Co., Ltd., Tokyo, Japan

[21] Appl. No.: 685,051

[22] Filed: Dec. 21, 1984

[30] Foreign Application Priority Data

Dec. 29, 1983 [JP] Japan ..... 58-248078

[51] Int. Cl.[4] ..... B05D 3/02; B05D 3/12

[52] U.S. Cl. ..... 427/362; 427/391; 428/511

[58] Field of Search ..... 427/362, 391; 428/511

[56] References Cited

U.S. PATENT DOCUMENTS 2,759,853 8/1956 Smith ..... 427/362

FOREIGN PATENT DOCUMENTS 816679 7/1959 United Kingdom ..... 427/362

854500 11/1960 United Kingdom ..... 427/362

OTHER PUBLICATIONS

*Paper and Paperboard Manufacturing Coating*, pp. 484, 487, 489, 490, 496, 561–562, 565–566, 569; vol. 186, Nos. 8, 9; Oct. 18, Nov. 1976.

*Primary Examiner*—Michael R. Lusignan

[57] ABSTRACT

A method of producing cast coated papers having a more uniform gloss, where the coated papers are produced by the rewet casting process, by using as the adhesive in the coating composition a copolymer latex containing as one of the copolymerized components an unsaturated carboxylic acid, and by adding to the coating, as an auxiliary agent, a metallic salt from a certain group.

8 Claims, 2 Drawing Figures

METHOD OF PRODUCING CAST COATED PAPER

BACKGROUND OF THE INVENTION

This invention relates to a method of producing cast coated paper. More particularly, the invention relates to a rewet casting method of producing cast coated paper having very favorable printability and high gloss at a high casting speed.

Conventional methods of producing cast coated high gloss paper for printing include (1) a wet casting method for obtaining a high gloss finish on the surface of the coating layer by pressing the paper carrying a coating layer in a wet state against a heated polished drum surface, (2) a gel-casting method for obtaining a high gloss finish on the surface of the coating layer by pressing the paper carrying a gelled coating layer against a heated polished drum surface, and (3) a rewet casting method for obtaining a high gloss finish on the surface of the coating layer by drying or half-drying a wet coating layer carried on the paper, plasticizing the layer by a rewetting step, and then pressing the coated surface on the paper against a heated polished drum surface.

In all of these cast coating finishing methods, a coating layer in a plastic state is pressed against and dried in contact with a heated drum surface and then is released therefrom. The difference in the plastic state of the coating layer between these methods, however, influences the ease of operation. Each of these methods has particular problems in obtaining quality cast coated paper, as outlined below.

In the wet casting method, a low speed operation at a heated drum surface temperature of below 100° C. is required because, at a temperature of above 100° C. the coating liquid is boiled and the coating layer is damaged.

In the gel-coating method, the gelled state of the coating layer allows the use of a heated drum temperature above 100° C. In practice, however, it is not possible to obtain a very high casting speed because a relatively large amount of water contained in the coating layer has to be transferred into the base paper when the paper is brought into contact with the surface of the heated drum at the press roll nip, and also because it becomes difficult to adjust the degree of gelling of the coating layer.

In the rewet casting method, it is possible to maintain the surface temperature of the heated drum in a range of 90° to 180° C. because the coating layer previously has been dried. However, the rewetting of the previously dried coating layer results in a far lower degree of plasticity of the coating layer than that of layers obtained by other methods. This results in uneven contact of the coating layer with the heated drum surface. Although in a lower speed operation a relatively uniform high-gloss coated paper can be obtained, an increase in operation speed markedly deteriorates the uniformity of the coating layer surface condition due to pinhold marks and non-uniform gloss.

In order to overcome this problem in the rewet casting, some approaches have been proposed including a method of preliminarily smoothing the coating layer by subjecting the same to sufficient supercalendering before rewetting, and a method of pressing the coating layer against the heated drum surface at a higher pressure. However, these methods sacrifice considerably the merits of the cast coated paper such as high bulkiness and high stiffness. Thus, in order to improve the uneven contact, a method of brushing the coated paper before rewetting has been proposed. This method can smooth the surface of the coating layer, but tends to densify said surface and to impede evaporation of moisture in the rewetted layer to such an extent as to hamper high speed cast finishing. Said densifying also retards drying of printing ink on cast coated papers, inducing ink set-off problems.

Furthermore, a rewet casting method, which is generally performed at a high temperature and a high pressure, tends to cause the migration of the binder in the coating layer towards the surface when a coating layer is reconstructed after rewetting. This tendency is intensified by increasing casting speed, so that the coating layer is weakened and this causes piling and other problems in the printing operations.

BRIEF SUMMARY OF THE INVENTION

The present invention relates to a novel rewet casting method which can effectively eliminate all the above-described drawbacks of the conventional rewet casting method, by using a specific copolymer latex as an adhesive component of the coating composition together with a specific metallic salt as an auxiliary agent.

More particularly, the invention relates to a method of producing cast coated paper by rewetting a previously dried coating layer, the main components of which are pigment, adhesive and auxiliary agent, and then by pressing said coating layer against a highly polished drum surface to obtain a finished high-gloss coating layer surface, characterized by using as an adhesive a copolymer latex produced employing an unsaturated carboxylic acid as a monomer unit, and by using as an auxiliary agent at least one member selected from a group consisting of zinc sulfate, zinc nitrate, zinc acetate, zinc formate, aluminum sulfate, aluminum nitrate, aluminate acetate, aluminum formate, magnesium sulfate, magnesium nitrate, magnesium acetate and magnesium formate.

PRIOR ART STATEMENT

Figure 1:
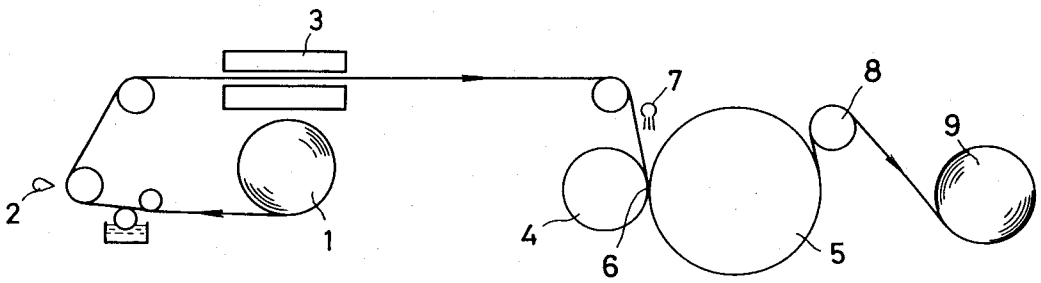
FIGS. 1 and 2 are schematic diagrams of cast coaters used in examples of the present invention.

As to auxiliary agents for a cast coating composition, the prior art suggests using a salt of organic or inorganic acids with zinc, aluminum, magnesium or other metals, as a gelling agent for casein or as a water-proofing agent. In a conventional rewet casting method, casein, carboxymethyl-cellulose and other film-forming materials are used as a rewetting liquid, and these metallic salts are contained in said coating composition, to obtain a cast coated paper having higher gloss (Japanese Patent Publication No. 19643/1975). Although accomplishing high gloss, this process tends to cause the rewetting liquid containing a film-forming material to stick to a highly polished drum surface, causing drum pickings and drum shadings that result in pinhole marks and non-uniform gloss on the surface of a cast coated paper, when the casting speed is higher. In order to avoid such disadvantages, salts have been added to facilitate the attainment of high gloss and decrease the amount of said film-forming material used. Such addition of salts, however, leads to the unsatisfactory result of lowering the strength of the coating layer surface.

On the other hand, a copolymer latex produced with an unsaturated carboxylic acid as a monomer unit has been generally used to improve the water retention characteristics of a coating composition for art paper or coated paper and to improve the surface strength of the coated paper obtained. Said latex also has been used in coating compositions for cast coated paper. It has been a current problem, however, that the low compatibility of said copolymer latex with casein tends to increase the viscosity of a coating composition with the result that separation of the coated paper from the casting surface becomes difficult and sometimes the gloss of the coated paper is lowered. In practice, therefore, the percentage of unsaturated carboxylic acid content in the latex has been limited to 0.5% by weight at the maximum.

DETAILED DESCRIPTION OF THE INVENTION

With this background, the inventors have found that when at least one of the salts of sulfuric, nitric, acetic or formic acids with zinc, aluminum or magnesium is used as special auxiliary agents in the coating compositions for a rewet casting method, in addition to ordinary auxiliary agents, and a copolymer latex produced using an unsaturated carboxylic acid as one of the monomers, is used as the whole or part of the adhesive for the coating compositions, in combination with said special auxiliary agent, then the rewet casting method will be free from problems such as non-uniform gloss, uneven contact of the coating composition with the drum surface, and insufficient printing surface strength, as well as from the above-mentioned disadvantages.

The reasons for such effects, although not fully clarified, would be that the metal cations from metallic salt which is added as an auxiliary agent, act on a carboxyl group in a copolymer latex so that a coating layer is made viscous and is solidified during a drying state (or step) until it becomes a highly porous and uniform layer, with the result that the passage of moisture is facilitated when the rewetted layer is pressed against the heated, highly polished drum in a rewet casting method process and better contact between the coating layer and the highly polished drum is obtained.

From this viewpoint, the inventors studied the combinations of said specific metallic salts and said specific copolymer latexes having unsaturated carboxylic acid, and also studied the proper quantitative ratios of such combinations. As a result, it has been found that only when said combinations are used in the specific ranges described below, can they display their beneficial effects.

First, the proper metallic salts to be used together with said copolymer latexes are limited to salts from the group consisting of the sulfates, nitrates, acetates and formates. No other metallic salts, such as the salts of hydrochloric acid with zinc or magnesium, can satisfactorily fulfill the objectives of the present invention, as demonstrated in Comparison Examples hereof. Besides, it is to be noted that salts of hydrochloric acid are not suitable for commercial use because they tend to corrode piping and cause rusting.

Similarly, even the use of sulfate, nitrate, acetate or formate salts, if they are salts of metals other than zinc, aluminum and magnesium, cannot satisfactorily fulfill the objectives of the invention.

The amount of metallic salt to be used preferably should be determined relative to the content of the unsaturated carboxylic acid in said copolymer latex. In general, the preferable amount of a metallic salt, in the case of the divalent metal salt such as that of zinc or magnesium, is at least 1 mol of metallic salt per 2 carboxyl groups contained in a copolymer latex, and in the case of the aluminum salt at least 1 mol of metallic salt per 3 carboxyl groups.

Zinc, aluminum or magnesium salt of sulfuric, nitric, acetic or formic acid, used in the present invention should preferably be mixed in the coating composition in an amount of approximately 0.5–10 parts by weight per 100 parts by weight of pigment. If the amount of said salt is less than 0.5 part by weight, the uneven contact of a coating layer with a highly polished drum will not be improved, and if the amount exceeds 10 parts by weight, the surface strength of paper for printing can be reduced and the viscosity of the coating composition may be increased. Among the above-mentioned salts, sulfate salts are most preferably used because of their remarkable effects. In order to avoid the tentative rise of viscosity that may be caused by the addition of the salt during the preparation of the coating compositions, the salt should preferably be added under well agitated and whirled conditions or after the pH is adjusted with aqueous ammonia or some other alkali.

The copolymer latexes having unsaturated carboxylic acid as a monomer unit, used in the invention, include copolymer latexes comprising unsaturated carboxylic acid copolymerized with copolymerizable monomers or polymers, said unsaturated carboxylic acids including monocarboxylic acids, such as acrylic acid and methacrylic acid, and dicarboxylic acids, such as fumaric acid, itaconic acid and maleic acid. Said polymers copolymerizable with unsaturated carboxylic acids include conjugated diene polymers such as styrene-butadiene copolymer, acrylic homo-polymer or copolymer of acrylic acid ester and/or methacrylic acid ester, and vinyl polymers such as ethylenevinyl acetate copolymer. These polymers are used singly or plurally.

The content of said unsaturated carboxylic acid in a copolymer latex should be 0.5–10% by weight thereof. If the content is below 0.5% by weight, the uneven contact of the coating layer with the drum will not be satisfactorily improved and the strength of paper for printing can hardly be improved. If the content exceeds 10% by weight, the viscosity of the latex obtained will increase and that of the coating composition will rapidly increase, with the result that the dried coating layer before being pressed on the highly polished drum will be nonuniform and the contact of the coating layer therewith will be uneven.

The specific copolymer latexes may be contained in a coating composition in an amount of 5–30 parts by weight, preferably 10–25 parts by weight, per 100 parts by weight of pigment. If the amount is below 5 parts by weight, the strength of paper for printing may not be satisfactory, and if the amount exceeds 30 parts by weight, releaseability from the casting surface can be impaired, and printability including ink absorbtivity can be lower.

In the method of the present invention, a coating composition which is to form a coating layer mainly comprises pigment, adhesive and auxiliary agent. The pigment may be one or more of the conventional pigments for coated paper, such as clay, kaolin, aluminum hydroxide, calcium carbonate, titanium oxide, barium sulfate, zinc oxide, satin white, and plastic pigment.

The main adhesive to be used comprises the above-mentioned specific copolymer latexes. Also, one or more conventional adhesives for coated paper may be used, including proteins such as casein, soybean protein, protein extracted from assimilative single cells with methanol or acetic acid; synthetic resins such as copolymer latexes containing no unsaturated carboxylic acid as a monomer unit; polyvinyl alcohol, olefinmaleic anhydride resin, and melamine resin; starches such as cationic starch and oxidized starch; and cellulose derivitives such as carboxymethyl-cellulose and hydroxyethyl-cellulose. The use of these additional adhesives must be limited within the harmless range for the intended effects of the present invention. Generally, the amount should be adjusted appropriately within the range of 1 to 20 parts by weight, and preferably 5 to 15 parts by weight, per 100 parts by weight of pigment.

Auxiliary agents include said specific metallic salts which are employed for the present invention as special auxiliary agents. Other auxiliary agents, which are used as necessary, include anti-foaming agents, dyestuffs, releasing agents and fluidity modifiers.

The coating composition blended in the above manner is applied in one or more layers onto base paper by means of an on-machine or off-machine coater such as a blade coater, an air knife coater, a roll coater, a brush coater, a curtain coater, a Champflex coater, a bar coater, a gravure coater or a size pressing coater. The solids content of the coating composition of this case is in general 40 to 70% by weight, preferably 45 to 65% by weight for good runnability.

The base paper may be a paper base or paperboard having a basis weight of 30 to 400 g/m$^2$, conventionally used for coated paper or cast coated paper for printing. These base papers are made from a furnish having an acid or alkaline pH. Of course, a medium-grade base paper containing high-yield pulp of at least approximately 10% by weight may be used. Also usable as the base paper are papers which have been semi-coated or pre-coated with a pigmented coating on one side or both sides.

The amount of a coating composition applied to the base paper is 10 to 50 g/m$^2$ (dry basis), most preferably 15 to 35 g/m$^2$ (dry basis) in view of white paper quality and cast coating speed of the cast coated paper.

The coating composition applied to a base paper is dried with a conventional drying apparatus employed for coated paper, such as a hot air dryer, air foil dryer, air cap dryer, cylinder dryer, infrared ray dryer, and electron radiation dryer. Depending upon the type of base paper and coating composition, the coated paper should be dried to a moisture content in a range of about 1 to 11%, preferably about 3 to 8%. A coated paper after drying may undergo calendering treatments such as machine calendering and super-calendering. Any calendering that may substantially impair the bulkiness and stiffness of a cast coated paper must, of course, be avoided.

Then, the coating layer is rewetted and pressed against a heated polished drum, according to the conventional rewet casting method. The method of the invention is effective particularly in high temperature and high speed rewet casting, because it has significant advantages when the drum temperature is above 95° C.

Liquid for the rewetting is not specifically limited. It may be any of conventional rewetting liquids, including an aqueous solution or emulsion that contains approximately 0.01 to 3% by weight of a releasing agent, such as polyethylene emulsions, soaps, calcium stearate, microcrystalline wax, surface-active agents and Turkey-red oil. In order to further reduce the uneven contact of the coating composition with the drum, it is of course, possible additionally to use alkalies, or phosphates such as sodium hexamethaphosphate and urea, so as to accelerate plasticization of a dried coating layer.

EXAMPLES AND COMPARISON EXAMPLES

Some examples of the present invention are described below. The invention is not limited to these examples. Unless otherwise specified, the parts and percentages in the examples and comparison examples, designate parts and percentages by weight.

Example 1–4, and Comparison Examples 1–8

50 parts of kaolin, 50 parts of precipitated calcium carbonate, and 0.5 part of sodium polyacrylate were dispersed in water by means of a Cowles dissolver so as to prepare a pigment slurry having a solids content of 60%. Then, 0.5 part of tributylphosphate as an anti-foaming agent, 1.0 part of ammonium stearate as a releasing agent, and as an adhesive 6 parts (solids content) of aqueous casein solution prepared with aqueous ammonia (concentration 15%), and 25 parts (solids content) of an acrylic acid/butadiene/styrene (2%/43%/55%) copolymer latex and additional water were added to said pigment slurry so that a coating composition having a solids content of 50% was prepared. The coating composition obtained in this manner was mixed with specific kinds of metallic salts shown in Table 1, at the ratios, per 100 parts of pigment, shown in Table 1. Ammonia was added to adjust the pH level to 9.0. Thus was obtained a coating composition having a final solids content of 45%.

With 12 kinds of coating compositions obtained in this manner, rewet casting was carried out by means of an apparatus illustrated in FIG. 1. Each of the coating compositions was applied to a paper base 1 having a basis weight of 80 g/m$^2$, with an air knife coater 2, so that the dry weight of the coating became 28 g/m$^2$. The paper was dried by a drier 3 to a moisture content of approximately 6%. The paper then was passed through a press nip 6 formed between a rubber-coated roll 4 having a diameter of 750 mm, and a chromium plated casting drum 5 having a diameter of 1500 mm. The coating layer was rewetted with an aqueous solution, supplied to the nip from a nozzle 7, containing ammonium stearate and sodium hexamethaphosphate (concentrations 0.5% and 0.5% respectively), as the paper is pressed against said casting drum 5, having a surface temperature of 105° C. and revolving at a speed of 80 m/min., the nip pressure being 200 kg/cm. After being dried, the coated paper was released from the casting drum at takeoff roll 8. Thus cast coated paper 9 was obtained.

The results of the quality evaluation of the cast coated papers obtained in Examples 1 to 4 and Comparison Examples 1 to 8 are shown in Table 1 below.

TABLE 1

| | Type of salt | Amount (%) | Ratio to acid in mol | Uneven contact | Gloss (%) | Strength for Printing |
|---|---|---|---|---|---|---|
| Comp. Example 1 | No salt | 0 | 0 | X X | 75 | O |

TABLE 1-continued

| | Type of salt | Amount (%) | Ratio to acid in mol | Uneven contact | Gloss (%) | Strength for Printing |
|---|---|---|---|---|---|---|
| Comp. Example 2 | Zinc sulfate | 0.3 | 0.3 | X | 77 | O |
| Example 1 | Zinc sulfate | 1.5 | 1.3 | O | 88 | O |
| Example 2 | Zinc sulfate | 3.0 | 2.7 | O | 89 | O |
| Comp. Example 3 | Zinc sulfate | 12 | 10.7 | O | 87 | X |
| Example 3 | Zinc nitrate | 1.5 | 1.1 | O | 84 | O |
| Example 4 | Magnesium acetate | 1.5 | 1.5 | O | 83 | O |
| Comp. Example 4 | Magnesium chloride | 1.5 | 2.3 | O | 82 | X |
| Comp. Example 5 | Sodium sulfate | 1.5 | 1.5 | XX | 75 | O |
| Comp. Example 6 | Potassium nitrate | 1.5 | 2.1 | XX | 75 | O |
| Comp. Example 7 | Calcium acetate | 1.5 | 1.4 | XX | 76 | O |
| Comp. Example 8 | Manganese formate | 1.5 | 1.5 | X | 78 | O |

Note:
Ratio to acid, in mol:
Indicated by the number of mols of the salt added per 1 mol of unsaturated carboxylic acid in the copolymer latex.
Evaluation of uneven contact:
"O" . . . Virtually no uneven contact observed on the coated surface after casting.
"X" . . . Considerable uneven contact observed on the coated surface after casting.
"XX" . . . A great amount of uneven contact observed on the coated surface after casting.
Evaluation of gloss:
Evaluated according to Japanese Industrial Standard P 8142. As the value increases, the paper is higher in gloss.
Evaluation of strength for printing:
Evaluated in terms of the frequency of picking occurence on the coating layer, when the coating layer was printed by an R1 printer with an ink having a high tack value.
"O" . . . Virtually no picking observed on the coating layer.
"X" . . . Picking observed on the coating layer; surface strength was insufficient.

EXAMPLES 5-9, AND COMPARISON EXAMPLES 9-12

70 parts of kaolin, 30 parts of precipitated calcium carbonate, and 0.5 part of sodium polyacrylate were dispersed in water by means of a Cowles dissolver so as to prepare a pigment slurry having a solids content of 60%. Then, 0.5 part of tributylphosphate as an anti-foaming agent, 1.0 part of ammonium stearate as a releasing agent, and as an adhesive 10 parts (solids content) of aqueous casein solution prepared with aqueous ammonia (concentration 15%), and 18 parts (solids content) of an acrylic acid/butadiene/methylmethacrylate (2%/33%/65%) copolymer latex and additional water were added to said pigment slurry so that a coating composition having a solids content of 50% was prepared.

The coating composition obtained in this manner was mixed with specific types of metallic salts shown in Table 2, at the ratios shown in Table 2. Ammonia was added to the coating composition to adjust its pH level to 8.0. Thus was obtained an aqueous coating composition having a final solids content of 43%. In Comparison Example 9, the coating composition was prepared in the same manner as in Example 5 except that it contained no metallic salt. In Comparison Example 12, the coating composition was prepared in the same manner as in Example 5 except that the acrylic acid/butadiene/-methylmethacrylate copolymer latex was replaced by a butadiene/methylmethacrylate (35%/65%) copolymer latex without an acrylic acid component.

With 9 kinds of coating compositions obtained in this manner, rewet casting was carried out by means of the apparatus illustrated in FIG. 1 in the same manner as in Example 1, except that a polyethylene emulsion having a concentration of 0.5% was used as a rewetting liquid.

The results of the quality evaluation of the cast coated papers obtained in Examples 5 to 9 and Comparison Examples 9 to 12 are shown in Table 2 below.

TABLE 2

| | Type of salt | Amount (%) | Uneven contact | Gloss (%) | Strength for printing |
|---|---|---|---|---|---|
| Example 5 | Zinc sulfate | 3.0 | O | 93 | O |
| Example 6 | Aluminum nitrate | 2.0 | O | 92 | O |
| Example 7 | Zinc acetate | 2.0 | O | 92 | O |
| Example 8 | Magnesium sulfate | 6.0 | O | 92 | O |
| Example 9 | Zinc formate | 2.0 | O | 92 | O |
| Comp. Example 9 | No salt | none | XX | 80 | O |
| Comp. Example 10 | Zinc sulfate | 0.2 | X | 84 | O |
| Comp. Example 11 | Zinc acetate | 14 | O | 92 | X |
| Comp. Example 12 | Zinc sulfate | 3.0 | X | 84 | X |

Notes:
Evaluation was made in the same manner as in Table 1.

EXAMPLES 10 AND 11, AND COMPARISON EXAMPLE 13

50 parts of kaolin, 40 parts of precipitated calcium carbonate, 10 parts of aluminum hydroxide, and 0.7 part of sodium polyacrylate were dispersed in water by means of a Cowles dissolver so as to prepare a pigment slurry having solids content of 65%. Then, 0.5 part of tributylphosphate as an anti-foaming agent, 0.55 part of ammonium oleate as a releasing agent, and as an adhesive 6 parts (solids content) of aqueous soybean protein solution prepared with aqueous ammonia (concentration 18%) were added to said pigment slurry, and the pH level thereof was adjusted to 9.5 by means of ammonia. This preparation was gradually mixed with an aqueous solution of 2.5 parts of zinc sulfate, and 20 parts (solids, content) each of specific copolymer latexes listed herein, and further ammonia and water. Thus was obtained a coating composition having a solids content of 48% and a pH of 8.5.

Figure 2:
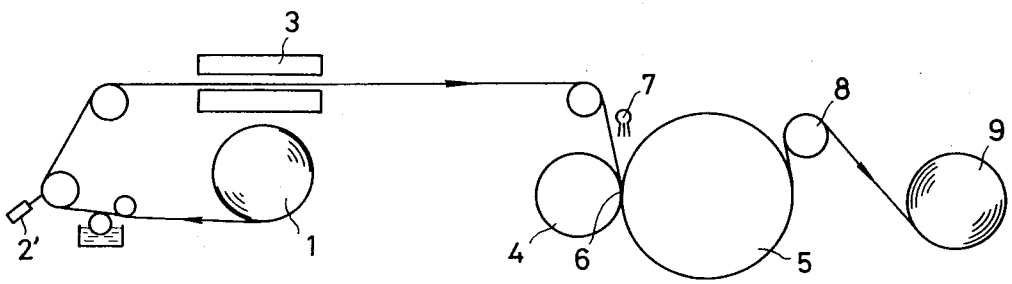

Rewet casting was carried out with this coating composition, by means of an apparatus illustrated in FIG. 2. Said coating composition was applied by a blade coater 2 to a paper base 1 having a basis weight of 90 g/m$^2$; the dry weight of the coating applied was 25 g/m$^2$. The base paper had a fiber composition of 30 parts of NBKP and 70 parts of LBKP and was sized with an alkylketene dimer sizing agent. The paper, after it was coated, was dried by a dryer 3 so that the moisture content of the paper became approximately 5.5%. Then the paper was passed through a press nip 6 formed between a press roll 4 having a diameter of 800 mm and a casting drum 5 plated with chromium and having a diameter of 3000 mm. The coating layer was rewetted as it passed through the nip with an aqueous solution supplied from a nozzle 7 and comprising 0.5 part of ammonium stearate, 1.0 part of urea, and 98.5 parts of water. Said layer was pressed against said casting drum 5 having a surface temperature of 105° C. and revolving at a speed of 70 m/min. at a nip pressure of 150 kg/cm. After being dried, the coated paper was released from the casting drum at takeoff roll 8. Thus cast coated paper 9 was obtained.

The types of copolymer latexes used were as follows:

Example 10: Crotonic acid/butadiene/styrene (5%/40%/55%) copolymer latex

Example 11: Methacrylic acid/butadiene/styrene (1.5%/41.5%/57%) copolymer latex.

Comparison Example 13: Methacrylic acid/-butadiene/styrene (12%/38%/50%) copolymer latex.

The results of the quality evaluation of the cast coated papers obtained in Examples 10 and 11 and Comparison Example 10 are shown in Table 3.

TABLE 3

| | Uneven contact | Gloss (%) | Strength for printing |
|---|---|---|---|
| Example 10 | O | 93 | O |
| Example 11 | O | 92 | O |
| Comp. Example 13 | X | 84 | O |

Note:
Evaluation was made in the same manner as in Examples 1 to 4.

What is claimed is:

1. A method of producing cast coated paper comprising the steps of rewetting a coating layer mainly composed of pigment and adhesive, and pressing said coating layer against a heated highly polished drum so as to obtain a high gloss finish on the surface of said coating layer, characterized by adding to the coating composition that forms said coating layer a salt from the group consisting of zinc sulfate, zinc nitrate, zinc acetate, zinc formate, aluminum sulfate, aluminum nitrate, aluminum acetate, aluminum formate, magnesium sulfate, magnesium nitrate, magnesium acetate and magnesium formate, as a special auxiliary agent, and by using as the whole or part of said ahesive a copolymer latex which contains an unsaturated carboxylic acid as a copolymerized monomer unit, the content of said unsaturated carboxylic acid in said copolymer latex being 0.5% to 10% by weight of said copolymer latex.

2. A method according to claim 1 wherein at least 1 mol of aluminum salt is added per 3 carboxyl groups contained in said copolymer latex used as an adhesive.

3. A method according to claim 1 wherein the special auxiliary agent added to a coating composition is one from the group consisting of zinc sulfate, aluminum sulfate and magnesium sulfate.

4. A method according to claim 1 wherein at least 1 mol of zinc salt or magnesium salt is added per 2 carboxyl groups contained in said copolymer latex used as an adhesive.

5. A method of producing cast coated paper comprising the steps of rewetting a coating layer mainly composed of pigment and adhesive, and pressing said coating layer on a heated highly polished drum so as to obtain a high gloss finish on the surface of said coating layer, characterized by adding to the coating composition that forms said coating layer a salt from the group consisting of zinc sulfate, zinc nitrate, zinc acetate, zinc formate, aluminum sulfate, aluminum nitrate, aluminum acetate, aluminum formate, magnesium sulfate, magnesium nitrate, magnesium acetate and magnesium formate, as a special auxiliary agent, in an amount of 0.5 to 10 parts by weight per 100 parts by weight of said pigment, and by using as the whole or part of said adhesive a copolymer latex which contains an unsaturated carboxylic acid as a copolymerized monomer unit, the amount of said copolymer latex used being 5 to 30 parts by weight per 100 parts by weight of said pigment, and the content of said unsaturated carboxylic acid in said copolymer latex being 0.5% to 10% by weight of said latex.

6. A method according to claim 5 wherein the special auxiliary agent added to a coating composition is one from the group consisting of zinc sulfate, aluminum sulfate and magnesium sulfate.

7. A method according to claim 5 wherein at least 1 mol of zinc salt or magnesium salt is added per 2 carboxyl groups contained in said copolymer latex used as an adhesive.

8. A method according to claim 3 wherein at least 1 mol of aluminum salt is added per 3 carboxyl groups contained in said copolymer latex used as an adhesive.

* * * * *